United States Patent [19]

Sova

[11] Patent Number: 4,944,807

[45] Date of Patent: Jul. 31, 1990

[54] PROCESS FOR CHEMICALLY STRIPPING A SURFACE-PROTECTION LAYER WITH A HIGH CHROMIUM CONTENT FROM THE MAIN BODY OF A COMPONENT COMPOSED OF A NICKEL-BASED OR COBALT-BASED SUPERALLOY

[75] Inventor: Vladimir Sova, Remetschwil, Switzerland

[73] Assignee: BBC Brown Boveri AG, Baden, Switzerland

[21] Appl. No.: 278,327

[22] Filed: Nov. 30, 1988

[30] Foreign Application Priority Data

Dec. 1, 1987 [CH] Switzerland ..... 4675/87

[51] Int. Cl.[5] ..... C23G 1/04

[52] U.S. Cl. ..... 134/3; 134/28; 134/41; 156/656; 156/664; 252/79.1; 252/79.2; 252/79.3; 252/79.4

[58] Field of Search ..... 156/656, 664, 903; 134/3, 28, 41; 252/79.2, 79.1, 79.3, 79.4

[56] References Cited

U.S. PATENT DOCUMENTS 3,458,353 7/1969 Baldi .
3,562,040 2/1971 Garies .
3,607,398 9/1971 Lucas .
3,622,391 11/1971 Baldi .
3,833,414 9/1974 Grisik et al. .
4,244,833 1/1981 Tomaszewski ..... 134/3 X
4,339,282 7/1982 Lada et al. ..... 134/3
4,410,396 10/1983 Somers et al. ..... 134/3 X
4,425,185 1/1984 Fishter et al. .
4,554,049 11/1985 Bastenbeck .
4,747,975 5/1988 Ritter ..... 134/3 X

FOREIGN PATENT DOCUMENTS 499835 11/1977 Australia .

OTHER PUBLICATIONS

Surface Treatment Technology Abstracts, vol. 29, No. 2, Mar. 1987, (Teddington, Middlesex, GB), O. A. Nazarov, et al.

*Primary Examiner*—David L. Lacey
*Assistant Examiner*—Thi Dang
*Attorney, Agent, or Firm*—Oblon, Spivak, McClelland, Maier & Neustadt

[57] ABSTRACT

Process for stripping, by electroless chemical method, a surface-protection layer (3) with a high chromium content from the main body (2) of a component composed of a nickel-based or cobalt-based superalloy by immersion in a chloride solution (1) which does not release oxygen, which contains iron (III) and copper (II) and which contains still further additives, but no components of any kind which form chromium oxide. Temperature of the bath 50° to 70° C. Duration of residence of the component in the bath 10 to 150 h.

Typical bath composition:
200–400 gl: $FeCl_3 . 6H_2O$
0.5–5 gl: $CuCl_2 . 2H_2O$
10–20 m/l: Glycerol
120–200 m/l: Concentrated HCl
Remainder: $H_2O$

8 Claims, 2 Drawing Sheets

PROCESS FOR CHEMICALLY STRIPPING A SURFACE-PROTECTION LAYER WITH A HIGH CHROMIUM CONTENT FROM THE MAIN BODY OF A COMPONENT COMPOSED OF A NICKEL-BASED OR COBALT-BASED SUPERALLOY

BACKGROUND OF THE INVENTION

1. Field of the Invention

Gas turbines require the highest standards of durability. The critical component is the blade in which layers for protection against erosion, wear, corrosion and oxidation at high temperatures are acquiring importance. The protective layer usually has a shorter service life than the core material of the blade, for which reason the renewability of the former is coming more and more to the fore.

The invention relates to the further development of processes for repairing, maintaining and renewing heat engine components rendered unusable by erosion, wear, corrosion, oxidation or mechanical damage and provided with protective layers. Under these circumstances, the old, existing protective layer first has to be removed, and this can in principle be carried out mechanically or chemically. The chemical method quite generally occupies a leading position in the field of surface modification by stripping.

In particular, it relates to a process for chemically stripping a surface-protection layer with a high chromium content from the main body of a component composed of a nickel-based of cobalt-based superalloy.

2. Discussion of Background

The removal of protective layers on main bodies (substrate) composed of superalloys is carried out in a conventional manner, inter alia, by the electroless chemical dissolution process by the action of solutions which contain oxidizing acids as an important component. Thus, the use of $HNO_3$-containing solutions for dissolving protective layers containing nickel aluminides is generally recommended (cf. US-A-4,425,185; AU-B-10761/76; US-A-4,339,282; US-A-3,607,398; US-A-3,622,391; US-A-3,833,414). Other oxidizing solutions contain, for example $H_2O_2$ and are used for stripping nickel (cf. US-A-4,554,049). The use of solutions which contain nitrobenzinesulfonic acid and Na compounds for chemically stripping so-called "aluminum diffusion layers" on blade materials is furthermore known (cf. EP-A-0,161,387). Furthermore, solutions containing iron sulfate and hydrochloric acid are recommended for removing chromium- and aluminum-containing protective coatings on a cobalt base, the iron sulfate having an oxidizing action either directly or by way of hydrolysis as sulfuric acid (cf. DE-B-2,717,435). In addition, solutions containing $HNO_3$ and HF have already been used for stripping chromium- and aluminum-containing or aluminum-containing protective layers from nickel or cobalt based alloys having a chromium content exceeding 18% (cf. US-A-3,458,353).

The known processes employing oxidizing solutions are based on the emperical fact that they only attack the core material of the main body, in the present case a nickel-based or cobalt-based superalloy, weakly if it contains at least 7% by weight of Cr. A process in which the main body is also stripped in addition to the protective layer is, of course, in most cases unusable in practice.

As a result of the changeover to increasingly higher Cr contents in the protective layers, however, the relationships of the electrochemical potentials of the core material to that of the protective layer is precisely reversed: The protective layer becomes positive compared with the main body in an oxidizing solution. This has the result that the protective layer cannot be removed either electrolytically or by electroless chemical means. The main body is preferably always attacked, whereas the protective layer to be removed resists longer. The above-mentioned known processes cannot therefore be used on the modern material combinations comprising a protective layer with high chromium content/a superalloy with moderate chromium content.

SUMMARY OF THE INVENTION

Accordingly, the object of the invention is to provide a process for stripping a surface-protection layer based on a Ni or Co alloy with high Cr content from the main body of a component which consists of a chromium-containing Ni-based and/or Co-based alloy. At the same time, the surface layer should be completely removed without the material of the main body being attacked, stripped or damaged, or impaired or altered in its chemical-physical properties and in its behavior in relation to compatibility, in particular, in the subsequent reapplication (renewal) of a surface-protection layer.

This object is achieved by the process mentioned in the introduction which comprises immersing the component for a time of 10 h to 150 h at a temperature in the range from 50° to 70° C. in an aqueous chloride solution which does not release oxygen, which contains iron (III) and copper (II) and which contains still further additives, but no components of any kind which form chromium oxide.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing. In this.

DESCRIPTION OF THE PREFERRED EMBODIMENTS

Figure 1:
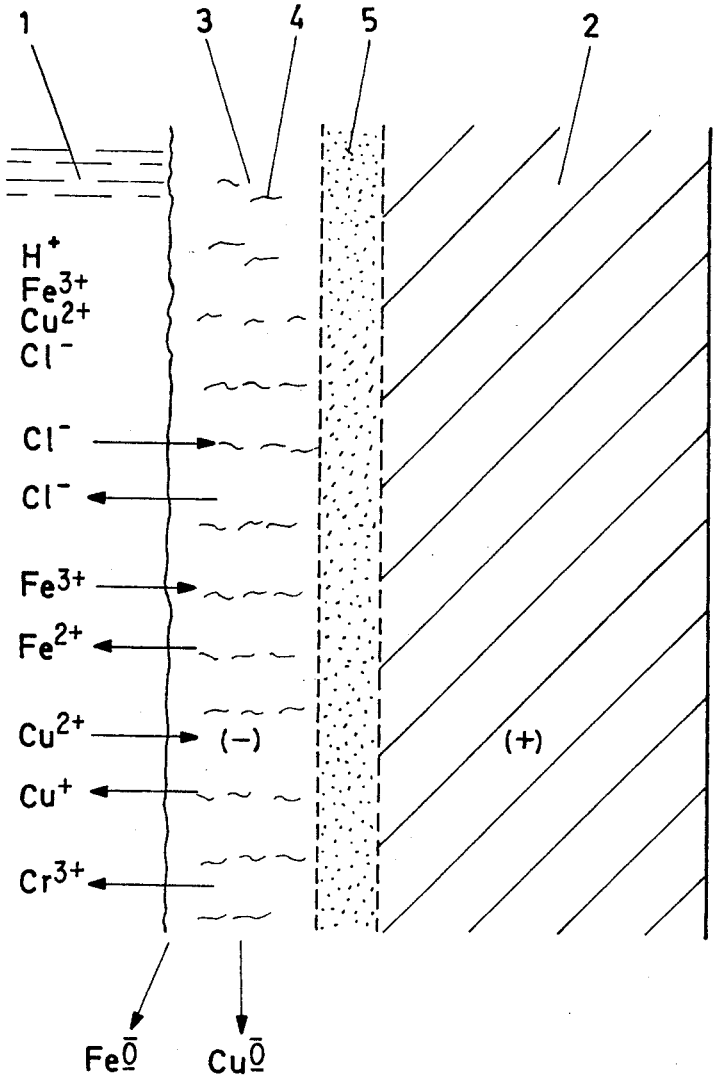
FIG. 1 shows a diagrammatic cross-section through the active part of the contents of a vessel for carrying out the process.

FIG. 1 shows a diagrammatic cross-section through the active part of the contents of a vessel for carrying out the process. The non-essential parts which do not participate critically in the principle sequence of the process, such as the vessel itself, stirring devices etc., have been omitted for the sake of clarity. 1 is the chloride solution for the chemical attack, 2 is the main body (substrate) composed of a nickel-based or cobalt-based superalloy (core material). 3 represents the surface-protection layer with a high chromium content. It may in principle be built up on a nickel or cobalt base. 4 are pores in the surface-protection layer 3 which are formed as a result of the chemical attack of the chloride solution 1. 5 is a diffusion intermediate layer between the main body 2 and the surface-protection layer 3 which forms as a result of a heat treatment during fabrication or in operation. On immersion in the solution 1, the surface-protection layer 3 exhibits a negative potential with respect to the main body 2 (indicated by the signs − and +), on which the process of electroless selective stripping of the former is based. The ions ($H^+$; $Fe^{3+}$; $Cu^{2+}$; $Cl^-$) mainly present are indicated in the chloride solution 1. The mechanism of dissolution is shown diagrammatically by symbols and arrows. Under these circumstances, the baser chromium preferably goes into solution ($Cr^{3+}$) whereas a portion of the iron and of the copper sinks to the bottom as sludge ($Fe^o$—; $Cr^o$—), the remainder remaining in solution in the form of lower valences ($Fe^{2+}$; $Cu^+$).

Figure 2:
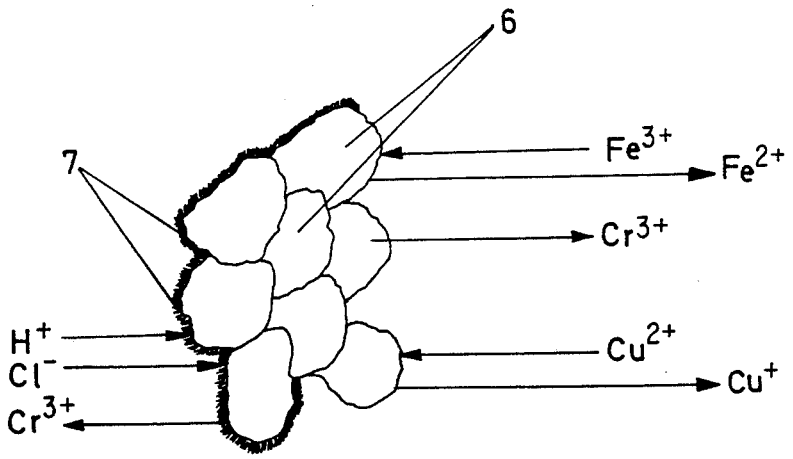
FIG. 2 shows a diagrammatic metallographic section through the grain structure of the surface-protection layer.

FIG. 2 shows a diagrammatic metallographic section through the grain structure of the surface-protection layer. 6 are grains of the surface-protection layer 3 with a high chromium content on a nickel base or cobalt base which contain, as a rule, also Al and Si in addition to Cr. At least a portion of the surface of the grains 6 is coated with a $Cr_2O_3$ covering layer which has a passivating action. The reaction mechanisms which are mainly active are indicated by arrows and symbols.

The invention is based on the selective dissolution, characterized by electrochemical potentials of different levels, of metals which are immersed in an aggressive chemical solution. Under these circumstances, the baser elementary metal, as a rule, displaces the nobler metal from the solution and goes into solution itself in doing so. The general reaction system under these circumstances is as follows:

$Me + Fe^{3+} \rightarrow Me^+ + Fe^{2+}$
$Me^+ + Fe^{3+} \rightarrow Me^{2+} + Fe^{2+}$
$Me + Cu^{2+} \rightarrow Me^+ + Cu^+$
$Me^+ + Cu^{2+} \rightarrow Me^2 + Cu^+$

Exemplary embodiment 1

A gas turbine blade which was provided with a surface-protection layer and whose blade leaf was corroded and partially damaged mechanically had the following dimensions (blade leaf):

Length = 185 mm
Maximum width = 93 mm
Maximum thickness = 24 mm
Profile height = 30 mm The core material of the gas turbine blade was composed of an oxide dispersion hardened nickel-based superalloy from INCO having the trade name MA 6000 of the following composition:

Cr = 15% by weight
W = 4.0% by weight
Mo = 2.0% by weight
Al = 4.5% by weight
Ti = 2.5% by weight
Ta = 2.0% by weight
C = 0.05% by weight
B = 0.01% by weight
Zr = 0.15% by weight
$Y_2O_3$ = 1.1% by weight
Ni = Remainder The 100 μm thick surface-protection layer had been applied to the core material by plasma jet spraying and had the following composition:

Cr = 20.5% by weight
Al = 11.5% by weight
Si = 2.5% by weight
Ta = 1% by weight
Co = 12% by weight
Ni = Remainder The used blade was cleaned by first immersing it in a 20% solution of NaOH for 24 h at 100° C. The blade was then removed from the solution, rinsed and immersed in concentrated HCl for 24 h at 40° C. Finally, the blade was rinsed and brushed with a steel brush.

After cleaning, the blade was immersed in a hot solution at 70° C. of the following composition:

300 g/l: $FeCl_3.6H_2O$
2.5 g/l: $CuCl_2.2H_2O$
15 ml/l: Glycerol
150 ml/l: Concentrated HCl
Remainder: $H_2O$ The blade was left for 15 h in this bath, then removed, rinsed and brushed. When this was done, no impairment of the core material by chemical attack could be detected.

Exemplary Embodiment 2

A gas turbine blade which was provided with a surface-protection layer and was irregularly worn over the entire length of the blade leaf was treated by the electroless process according to Example 1. The blade leaf had the same dimensions and the core material (MA 6000) had the same composition as in Example 1. The 120 μm thick surface layer had been applied to the core material by plasma jet spraying and had the same composition as in Example 1. The used blade was cleaned according to Example 1 by immersion in NaOH and HCl solution and treatment with a steel brush.

After cleaning, the blade was immersed in a bath of the following composition:

500 g/l: $FeCl_3.6H_2O$
5 g/l: $CuCl_2.2H_2O$
20 ml/l: Glycerol
Remainder: $H_2O$ The bath had a temperature of 50° C. After a reaction time of 14 h, the blade was removed from the bath, rinsed, brushed and dried. The surface layer had been completely dissolved without the substrate having been attacked.

Exemplary Embodiment 3

A gas turbine blade which was provided with a surface-protection layer and whose blade leaf was partially corroded had the following dimensions (blade leaf):

Length = 170 mm
Maximum width = 86 mm
Maximum thickness = 22 mm
Profile height = 27 mm The core material of the gas turbine blade was composed of a nickel-based cast superalloy from INCO having the trade name IN 738 and the following composition:

Cr = 16.0% by weight
Co = 8.5% by weight
Mo = 1.75% by weight
W = 2.6% by weight
Ta = 1.75% by weight
Nb = 0.9% by weight
Al = 3.4% by weight
Ti = 3.4% by weight
Zr = 0.1% by weight
B = 0.01% by weight
C = 0.11% by weight
Ni = Remainder The 120 μm thick surface-protection layer had been applied to the core material by plasma jet spraying and had the following composition:

Cr=25% by weight
Al=7% by weight
Y=0.7% by weight
C<0.002% by weight
Co=Remainder The partially corroded blade was cleaned according to Example 1 and then placed in a solution of the following composition:

200 g/l: $FeCl_3.6H_2O$
1 g/l: $CuCl_2.2H_2O$
10 ml/l: Glycerol
30 ml/l: Concentrated HCl
Remainder: $H_2O$ The bath had a temperature of 70° C. The treated gas turbine blade was removed from the bath after a reaction time of 144 h, rinsed, brushed and dried. After complete dissolution of the surface-protection layer, no attack of the core material could be detected.

Examplary Embodiment 4

A gas turbine blade which was provided with a surface-protection layer and which was irregularly corroded over the entire length of the blade leaf was treated by the electroless process similar to Example 1. The blade leaf had the same dimensions and the core material (IN 738) had the same composition as in Example 3.

The surface-protection layer was on average 150 μm thick and had previously been applied to the core material by plasma jet spraying. It had the same composition as that of Example 3.

The used blade was cleaned according to Example 1 and then immersed in a solution of the following composition:

300 g/l: $FeCl_3.6H_2O$
2 g/l: $CuCl_2.2H_2O$
20 ml/l: Concentrated HCl
Remainder: $H_2O$ The bath had a temperature of 60° C. The blade was removed from the solution after a reaction time of 120 h, rinsed, brushed and dried. With complete dissolution of the surface-protection layer, no attack of any kind on the core material could be detected.

Exemplary Embodiment 5

The experiment according to Example 4 was repeated, the solution for removing the surface-protection layer having, however, the following composition:

300 g/l: $FeCl_3.6H_2O$
1 g/l: $CuCl_2.2H_2O$
30 g/l: $NH_4HF_2$
Remainder: $H_2O$ The bath temperature was 60° C., the total reaction time 1 h. After the treatment, the core material had remained unattacked.

Exemplary Embodiment 6

A gas turbine blade which was provided with a surface-protection layer and which was irregularly corroded over the entire length of the blade leaf was treated by the electroless process similar to Example 1. The blade leaf had the same dimensions and the core material (IN 738) had the same composition as in Example 3.

The surface-protection layer was on average 120 μm thick and had previously been applied to the core material by plasma jet spraying. It had the same composition as that of Example 3. The used blade was cleaned according to Example 1 and then immersed in a solution of the following composition:

250 g/l: $FeCl_3.6H_2O$
1 g/l: $CuCl_2.2H_2O$
100 g/l: NaCl
200 g/l: Citric acid
Remainder: $H_2O$ The bath had a temperature of 65° C. The blade was removed from the solution after a reaction time of 100 h, rinsed, brushed and dried. With complete dissolution of the surface-protection layer, no attack of any kind of the core material could be detected.

Exemplary Embodiment 7

The experiment according to Example 6 was repeated, but the solution for removing the surface-protection layer had, however, the following composition:

300 g/l: $FeCl_3.6H_2O$
0.5 g/l: $CuCl_2.2H_2O$
50 g/l: NaCl
100 g/l: Oxalic acid
Remainder: $H_2O$ The bath had a temperature of 60° C., the total reaction time was 1 h. After the treatment, the core material had remained unattacked.

The invention is not restricted to the exemplary embodiments. The electroless chemical stripping of a surface-protection layer with a high chromium content from a nickel-based or cobalt-based superalloy is achieved by immersion of the respective component in an aqueous chloride solution which does not release oxygen, which contains iron (III) and copper (II) and which contains still further additives, but no components of any kind which form chromium oxide for a period of 1 h to 150 h at a temperature of 50° to 70° C. Advantageously, the chloride solution has the composition:

200–400 g/l: $FeCl_3.6H_2O$
0.5–5 g/l: $CuCl_2.2H_2O$
10–20 ml/l: Glycerol
120–200 ml/l: Concentrated HCl
Remainder: $H_2O$ Obviously, numerous modifications and variations of the present invention are possible in light of the above teachings. it is therefore to be understood that within the scope of the appended claims, the invention may be practised otherwise than as specifically described herein.

What is claimed and desired to be secured by Letters Patent of the United States is:

1. A process for chemically stripping a surface-protection layer with a high chromium content from a main body of a component composed of a nickel-based or cobalt-based superalloy, comprising immersing the component for a time of 1 h to 150 h at a temperature in the range from 50° to 70° C. in an aqueous chloride solution which does not release oxygen, which contains iron (III) and copper (II) and which contains still further additives, but no components of any kind which form chromium oxide.

2. A process as claimed in claim 1, wherein the solution (1) has the following composition:

200–400 g/l: $FeCl_3.6H_2O$
0.5–5 g/l: $CuCl_2.2H_2O$
10–20 ml/l: Glycerol
120–200 ml/l: Concentrated HCl
Remainder: $H_2O$.

3. A process as claimed in claim 1, wherein the solution (1) has the following composition:

500 g/l: $FeCl_3.6H_2O$
5 g/l: $CuCl_2.2H_2O$
20 ml/l: Glycerol
Remainder: $H_2O$.

4. The process as claimed in claim 1, wherein the solution (1) has the following composition:

200 g/l: $FeCl_3.6H_2O$
1 g/l: $CuCl_2.2H_2O$
10 ml/l: Glycerol
30 ml/l: Concentrated HCl
Remainder: $H_2O$.

5. The process as claimed in claim 1 wherein the solution (1) has the following composition:

300 g/l: $FeCl_3.6H_2O$
2 g/l: $CuCl_2.2H_2O$
20 ml/l: Concentrated HCl
Remainder: $H_2O$.

6. The process as claimed in claim 1 wherein the solution (1) has the following composition:

300 g/l: $FeCl_3.6H_2O$
1 g/l: $CuCl_2.2H_2O$
30 g/l: $NH_4HF_2$
Remainder: $H_2O$.

7. The process as claimed in claim 1, wherein the solution (1) has the following composition:

250 g/l: $FeCl_3.6H_2O$
1 g/l: $CuCl_2.2H_2O$
100 g/l: NaCl
200 g/l: Citric acid
Remainder: $H_2O$.

8. The process as claimed in claim 1, wherein the solution (1) has the following composition:

300 g/l: $FeCl_3.6H_2O$
0.5 g/l: $CuCl_2.2H_2O$
50 g/l: NaCl
100 g/l: Oxalic acid
Remainder: $H_2O$.

* * * * *